US010046839B2

(12) United States Patent
Falken

(10) Patent No.: US 10,046,839 B2
(45) **Date of Patent: *Aug. 14, 2018**

(54) REINFORCED SURF LEASH

(71) Applicant: EFFEKT LLC, Solana Beach, CA (US)

(72) Inventor: Robert Falken, Oceanside, CA (US)

(73) Assignee: TECNIQ Holdings, LLC, Solana Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/444,116

(22) Filed: Feb. 27, 2017

(65) Prior Publication Data

US 2017/0166287 A1 Jun. 15, 2017

Related U.S. Application Data

(63) Continuation of application No. 14/738,574, filed on Jun. 12, 2015, now Pat. No. 9,580,154, which is a continuation-in-part of application No. 14/295,127, filed on Jun. 3, 2014, now Pat. No. 9,248,891.

(60) Provisional application No. 61/830,588, filed on Jun. 3, 2013.

(51) Int. Cl.
*B63B 35/79* (2006.01)

(52) U.S. Cl.
CPC .... *B63B 35/7933* (2013.01); *B63B 2035/794* (2013.01)

(58) Field of Classification Search
CPC ..... B63B 35/79; B63B 35/7933; B63B 35/00; B63B 35/85; B29C 65/00; B29C 45/14; B23P 11/00; B23P 11/02
USPC ..... 441/75
See application file for complete search history.

(56) References Cited

U.S. PATENT DOCUMENTS

| | | | |
|---|---|---|---|
| 4,176,705 | A | 12/1979 | Russell et al. |
| 4,534,163 | A | 8/1985 | Schuerch |
| 4,610,634 | A | 9/1986 | Kimura |
| 5,875,543 | A | 3/1999 | Fujimoto et al. |
| 6,500,039 | B1 | 12/2002 | Underwood |
| 8,079,208 | B2 | 12/2011 | Volpi |
| 8,834,221 | B2 | 9/2014 | Cregan |
| 9,248,891 | B2 | 2/2016 | Falken |
| 2009/0017244 | A1 | 1/2009 | Martino et al. |
| 2015/0274265 | A1 | 10/2015 | Falken |
| 2016/0152308 | A1 | 6/2016 | Falken |

*Primary Examiner* — Lars A Olson
(74) *Attorney, Agent, or Firm* — Mintz Levin Cohn Ferris Glovsky and Popeo, P.C.

(57) ABSTRACT

A surfboard leash apparatus is disclosed. The surf leash apparatus includes a cuff for attaching to a limb of a surfer, the cuff having an inner surface, the inner surface of the cuff having a pattern of compressible grips disposed thereon. The surf leash further includes an attachment mechanism for attaching to a surfboard, and a leash cord connected between the cuff and the attachment mechanism. The leash cord includes an elastic fiber rope core having a predetermined amount of stretch, and an extruded thermoplastic urethane cord surrounding the elastic fiber rope core. The extruded thermoplastic urethane cord has an elasticity corresponding to the predetermined amount of stretch of the elastic fiber rope.

10 Claims, 5 Drawing Sheets

REINFORCED SURF LEASH

CROSS REFERENCE TO RELATED APPLICATIONS

The current application is a continuation of U.S. patent application Ser. No. 14/738,574 filed on Jun. 12, 2015, which is a continuation-in-part application that relates to and claims priority under 35 U.S.C. § 119(e) to U.S. patent application Ser. No. 14/295,127 filed on Jun. 3, 2014, which claims the benefit of U.S. Provisional Patent Application No. 61/830,588 filed on Jun. 3, 2013, the disclosures of which are incorporated herein by reference in their entirety.

BACKGROUND

The present invention relates to leashes used for surfboards or other similar devices such as bodyboards or paddleboards, and more particularly relates to a reinforced surfboard leash cord. Surfboard leashes are utilized as a means to connect surfers to their surfboards in a reliable manner with minimal drag. The main advantage of using a surfboard leash is that surfers don't easily become separated from the surfboards, thus alleviating the need to swim in order to recover the surfboard after a wipeout. If a surfer should become separated from a surfboard they could have to swim a considerable distance to recover the surfboard and risk fatigue or drowning. An additional advantage of using a surfboard leash is that the surfboard won't easily become dislodged and collide with other surfers causing damage or injury to either the surfboards or the surfers themselves.

Conventional surfboard leashes are comprised of a length of extruded thermoplastic urethane cord and connection parts such as molded joints, swivels, webbing, hook and loop fasteners, a leash string, and an ankle cuff. Typically, surfboard leashes are provided in the same length or slightly longer than the surfboard for which they are intended. Surfboard leashes are attached to surfboards on one end of the cord by connection parts and the other end securely connects the ankle cuff to the ankle of the surfer.

Extruded thermoplastic urethane leash cords have a minor amount of elasticity to reduce the brunt of the force applied to the surfer's leg when the surfer becomes momentarily separated from the surfboard after a wipeout. The cords are provided in varying diameters depending on the intended conditions of use. For example, conventional leash cords are provided in diameters such as 5 millimeters, 6 millimeters, or 8 millimeters. The thickness of the leash cord is directly proportional to the cords breaking strength. Typically, surfers use smaller diameter cords for small waves since small waves generally have less power and less force applied to the cord. Conversely, thicker diameter cords are utilized for big waves since big waves generally have more power and apply significantly more force to the cord. Additionally, the thickness of the leash cord is directly proportional to an increase in the amount of drag experienced while surfing. Increased drag can create a uncomfortable ride for the surfer or slow the desirable speed of the surfboard's acceleration in use.

Regardless of the diameter of the leash cord, extruded thermoplastic urethane cords can and do break during use. The breaking can be caused by many factors. For example, the surfboards fin can become entangled with the leash and slice the cord at high speed, which is known by surfers as "fin cuts". These "fin cuts" weaken the cord and reduce the breaking strength of the cord to the point of breakage under nominally applied force. Further, a bad formulation of the extruded TPU cord can result in weak spots within the cords construction that can cause breakage under the force of even traditionally small waves. Further still, surfing waves, regardless of size, can employ uncontrolled amounts of force to an object such as a surfboard since surfing waves are an unpredictable force of nature. As such, even a small wave might be able to apply enough force to break a thick surfboard leash cord. Thus, a need exists for surfboard leash cords that won't easily break due to the limitations mentioned above.

SUMMARY

This document presents surfboard leash cords with improved durability and reduced drag. According to one aspect, an extruded thermoplastic urethane surfboard leash cord is provided with a reinforced elastic fiber core.

In one aspect, a surfboard leash apparatus is disclosed. The surf leash apparatus includes a cuff for attaching to a limb of a surfer, an attachment mechanism for attaching to a surfboard, and a leash cord connected between the cuff and the attachment mechanism. The leash cord includes an elastic fiber rope core having a predetermined amount of stretch, and an extruded thermoplastic urethane cord surrounding the elastic fiber rope core. The extruded thermoplastic urethane cord has an elasticity corresponding to the predetermined amount of stretch of the elastic fiber rope.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document relates to surf leashes desirably have an ankle attachment surface that can be securely gripped to prevent slipping or rotating around the ankle of a wearer. Preferably, high friction elastomeric materials are disposed on the outer exposed fabric surface (i.e. inner surface) of the surf leash ankle attachment, commonly referred to as an ankle cuff. The elastomeric material disposed on the outer exposed fabric faces inwardly towards the ankle of a wearer thereby contacting the wearer's skin with the elastomeric materials to reduce slipping or movement of the ankle cuff of the present invention. The reduction or elimination of the ankle cuff from slipping ensures that the attached reinforced surf leash cord will not become tangled with the wearer while in use. This document also describes a surfboard leash, and more particularly a surfboard leach with a reinforced cord that provides additional strength and protection against breakage, while also providing the necessary elasticity and/or elongation.

In some implementations, a cuff has an inner surface, and the inner surface of the cuff includes a gripping surface. The gripping surface can include an elastomeric material, preferably silicone gripping dots, having a durometer and a coefficient of friction effective to provide a good gripping surface, as well as enhanced adhesion to a variety of substrates such as fabric laminated neoprene, fabric laminated Styrene-butadiene rubber (SBR), or fabric laminated neoprene and SBR blends. Additionally, any desirable flexible foam may be utilized for the fabric laminated composition of the cuff, whether by solvent-based adhesive lamination methods or hot melt adhesive lamination methods. The gripping surface can be applied at a thickness of less than or equal to 2.5 mm. Additionally, thicknesses of greater than 2.5 mm thickness may also be utilized, but can be more prone to tearing due to repeated use.

Figure 1:
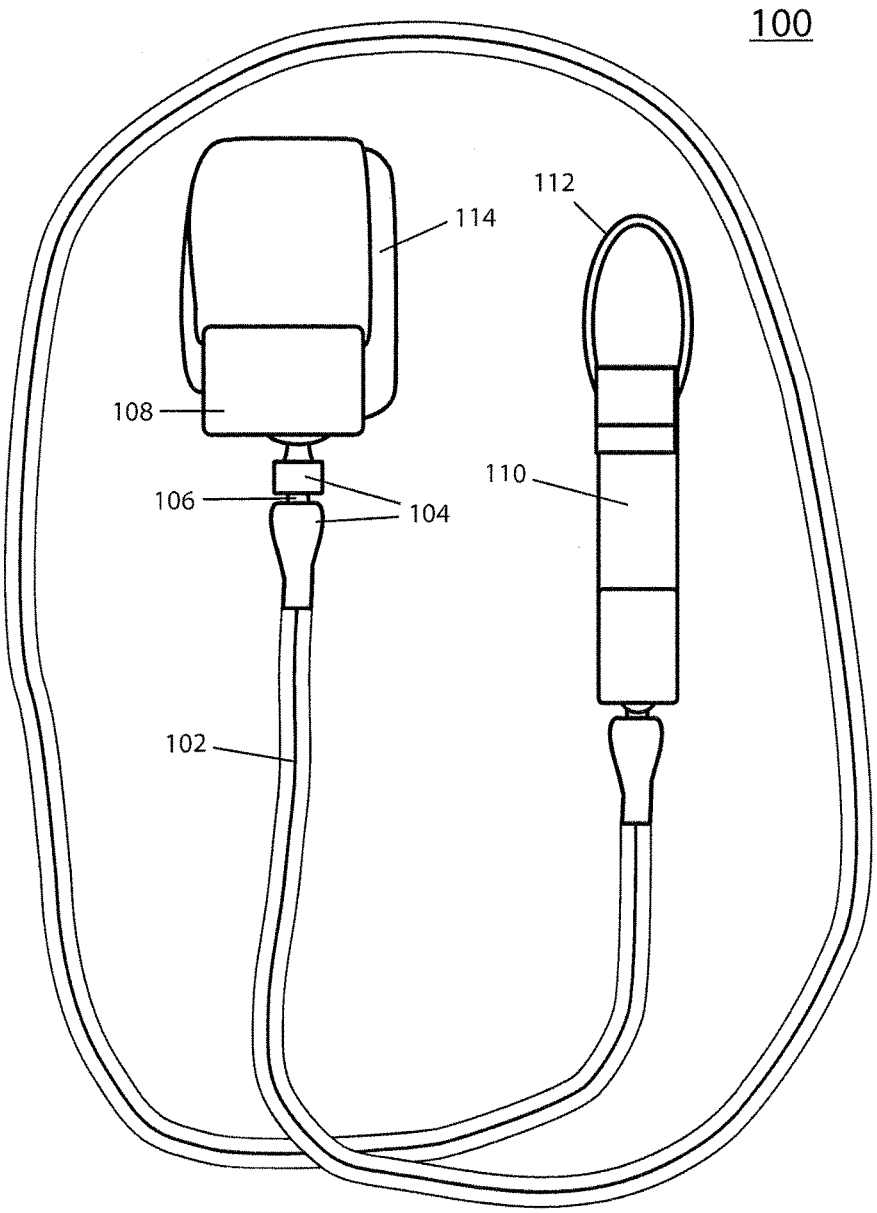
FIG. 1 provides a side view of a surfboard leash formed in accordance with an implementation.

Referring first to FIG. 1, a side view of a surfboard leash with reinforced cord 10 formed in accordance with an implementation is shown. The surfboard leash includes an extruded thermoplastic urethane reinforced cord 10, molded joints 20, swivels 30, webbing 40, hook and loop fasteners 50, a leash string 60, and an ankle cuff 70.

Figure 2:
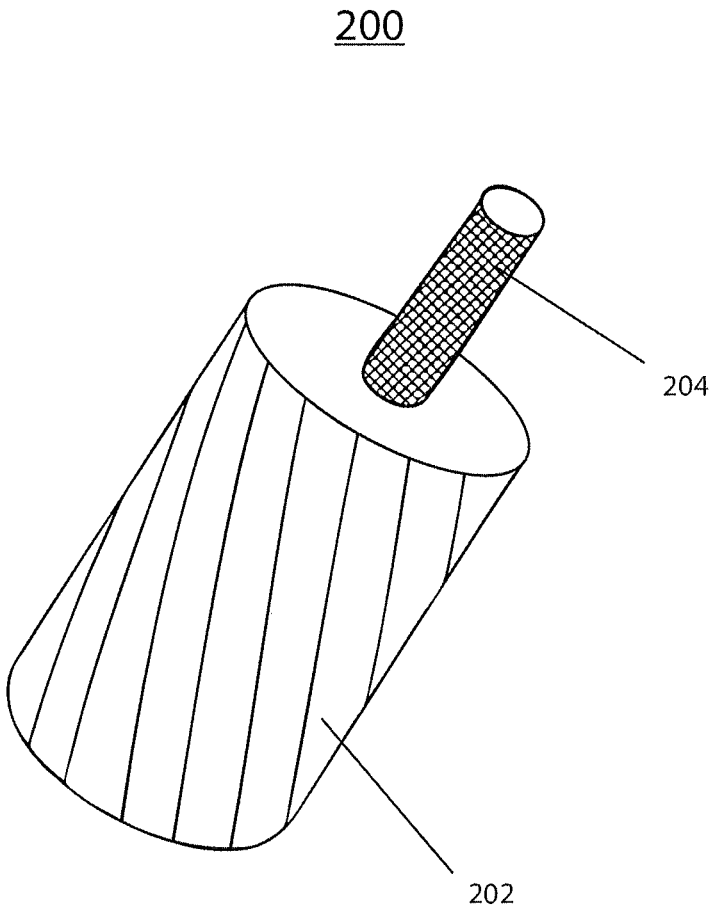
FIG. 2 illustrates a cross-sectional view of the reinforced surfboard leash cord implementation.

Referring to the cross-section shown in FIG. 2, the reinforced surfboard leash cord 10 includes an outer portion 12 of extruded thermoplastic urethane cord encapsulating an inner portion 14 of elastic fiber rope.

According to some implementations, various shore hardness's of thermoplastic urethane may be used to make the extruded thermoplastic urethane cord of the outer portion 12 in the surfboard leash cord of the present invention. Shore hardnesses, for example, less than 80 shore A, and preferably 85 to 90 Shore A are well suited for making the extruded thermoplastic urethane cord of the outer portion 12 of the present invention. Other shore hardness's may also be used to make the extruded thermoplastic urethane cord of the outer portion 12 of the present invention. According to other implementations, the inner portion 14 of the reinforced surfboard leash cord is formed of an elastic meta-aramid rope.

One alternative construction of the inner portion 14 of the reinforced surfboard leash cord, by example and without limitation, is a polypropylene/spandex-blended rope. In various examples of such constructions disclosed in the incorporated references, the rope includes between about 5% and about 20% by weight of the elastic fibers. Any suitably optimized rope composition can be used in a given situation.

Additionally, any suitable rope can be employed that exhibits mildly elastic properties of any suitable type to form a substantially continuous elastic core in the reinforced cord. The inner portion 14 can be assembled in any suitable arrangement. The rope fibers can be braided, plaited, or spun with elastic fibers to form the inner portion. Examples of suitable rope fibers include typical rope fibers, e.g., sisal, manila, jute, hemp, or other natural polyamide fibers; rayon, cotton, or other cellulosic fibers; nylon, polyester, polyethylene terephthalate, polypropylene, Ultra-High molecular weight polyethylene (UHMWPE), aramid, or other synthetic fibers. Alternatively, an elastic coating can be applied to a surface of a non-elastic rope to form the inner portion. In that latter case, the elastic fibers can be combined with the non-elastic fibers in any suitable way, including those described above or others not explicitly disclosed herein, and all such combinations shall fall within the scope of the present disclosure.

Figure 3:
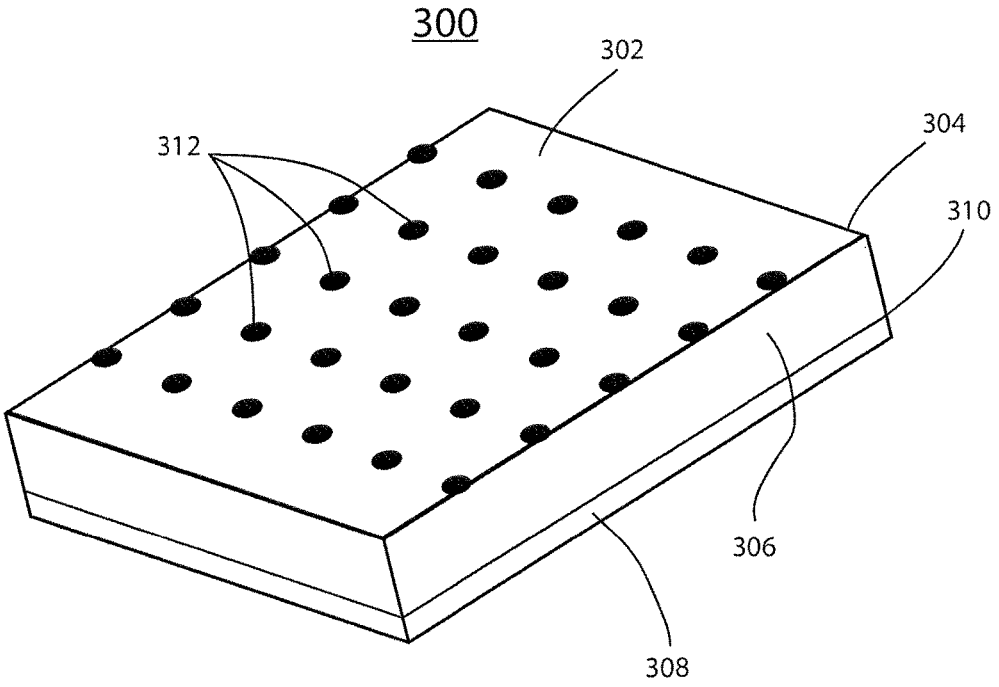
FIG. 3 is an enlarged perspective view, partly in cross section, of the material of the present invention showing the inner layer of surf leash ankle cuff wherein a layer of silicone gripping dots are adhered to the outer layer of the fabric material, and the opposite side of the fabric layer adhesive laminated to a flexible foam. Also shown is yet another layer of fabric laminated onto the backside of the flexible foam.

FIG. 3 is a perspective view of a cross-section of a cuff 300 formed of one or more layers of foam 304 and/or fabric 308. The foam 302 can have a thickness 306 that is suitable to be comfortably cuffed around a wearer's ankle, leg, wrist or arm. The foam 304 be Neoprene® or the like. The fabric 308 can be nylon, polyester or the like. The foam 304 can be bonded, affixed or attached to fabric 308 by adhesive 310, by sewing or stitching, by rivets or other connecting mechanism. An inner surface 302 of the foam 304 can be covered by a second fabric layer by adhesive, by sewing, by lamination, or the like.

The inner surface 302 can also include a number of compressible grips 312. The compressible grips 312 extend from the inner surface 302 of the foam 304 such that when the foam 304 and cuff 300 are cuffed around a body part of a wearer, the compressible grips 312 face inwardly toward or against the wearer's skin or wetsuit, and resist against rotational movement of the cuff 300 around the wearer's body part. In some implementations, the compressible grips 312 are attached to the inner surface 302 of the cuff 300 as a pattern of dots or small bumps. In other implementations, the compressible grips 312 can be laid out in a pattern of lines or other patterns. The compressible grips 312 can be made of any compressible yet frictional material such as silicone or the like.

Figure 4:
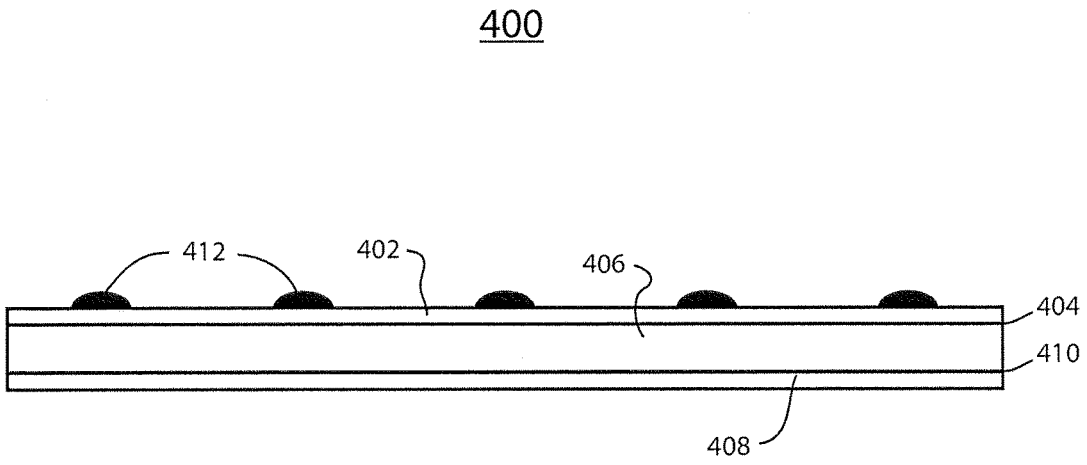
FIG. 4 is a partial and cross-sectional view of one embodiment of the material of the present invention comprising a silicone layer and a fabric layer, together with an adhesive layer, flexible foam layer, and additional adhesive layer and fabric layer.

FIG. 4 is a side view of a cuff 400 to illustrate compressible grips 412 on an inner layer of material 402 that overlays a foam layer 406. The inner layer of material 402 can be joined to the foam layer 406 by adhesive 404, by lamination, by sewing or the like. An outer layer of material 408 can be overlaid on the foam layer 406 on an opposite side of the foam layer 406 than the inner layer of material 402, and also affixed or joined by an adhesive layer 410. The adhesive layer 410 can include stitching, rivets, glue, or the like.

Figure 5:
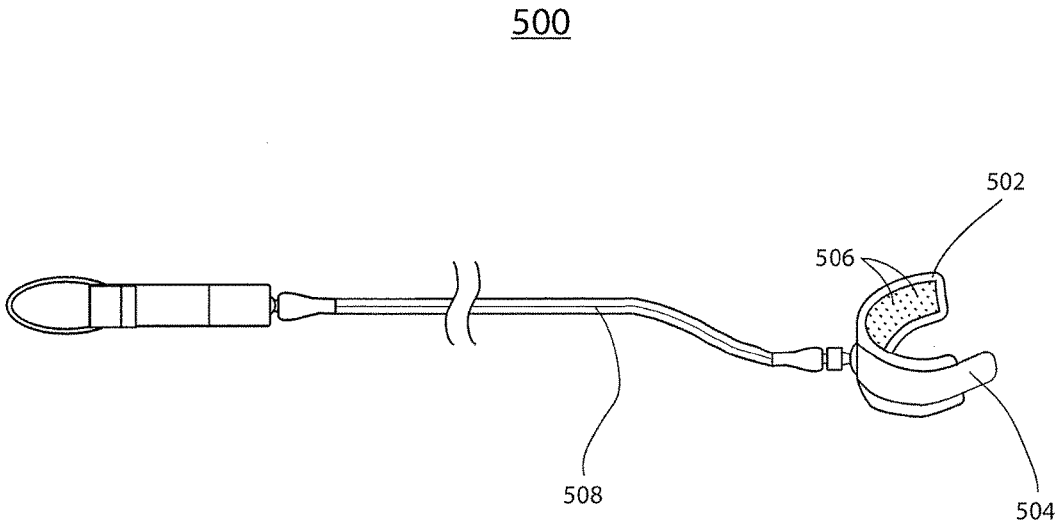
FIG. 5 is a perspective view of the reinforced surfboard leash of the present invention.

FIG. 5 illustrates a surf leash 500 having a cuff 502 to attach around a part of a wearer's body such as the wearer's ankle, leg, wrist or arm, an attachment mechanism 504 to secure the attachment of the cuff 502 around the part of the wearer's body. The attachment mechanism 504 can include a hook and loop fastener, a button, a snap, a tying member, or the like. The cuff 502 is coupled with a leash cord 508, such as is described above. The leash cord 508 can in turn be coupled with a surf board or watercraft by a coupling mechanism, which can include rope, hook and loop fastener, or the like. An inner surface of the cuff 502 can include compressible grips 506, which, when the cuff is secured around the part of the wearer's body, inhibits or prevents the cuff 502 from rotating around that part of the wearer's body. Accordingly, the wearer can position the cuff 502 in order to have the leash cord 508 extend at a particular desired position from the part of the wearer's body, and the compressible grips 506 maintain the cuff in that position. This can prevent the leash cord 508 from being tangled with the wearer's body or the wearer's board or watercraft, when in use.

The elastomeric material is chosen to be adequately soft to provide the necessary gripping capability as used in contact with skin or another fabric surface, while comfortable to a wearer. A Shore A Durometer of less than or equal to 60 provides the ideal characteristics for improving the coefficient of friction of the surf leash ankle cuff thereby greatly reducing or eliminating the affixed surf leash cord of the present invention from becoming tangled when in use.

Various elastomers may be useful as the coatings in the form of different patterns with different spacings, etc. The various elastomers include silicones such as heat-cured silicones, condensation-cured silicones and RTV silicones. The elastomers may be applied by any of various methods which results in adequate bonding for the intended application. A preferred elastomer is RTV 863 from GE Silicones, Inc., Waterford, N.Y. This has been applied by gravure printing onto the desired fabric surface of the substrate material and subsequently cured by heating appropriately. Exposure to a temperature of about 160 degrees C. for two minutes has been effective. In a preferred exemplary implementation, silicone gripping dots are disposed onto a fabric surface, preferably polyester or nylon, and then a multilayer ankle cuff is assembled utilizing the above mentioned components.

There remains a need in the art for a gripping surface on the inside (skin-contact side) of a surf leash ankle attachment, commonly referred to as an ankle cuff.

A single silicone grip can have a variety of finishes, for example one portion of the exterior surface can have a smooth surface finish, and another portion of the exterior surface can have a textured surface finish. Desirably, the surface finish is textured to improve the coefficient of friction of the surface under wet conditions.

Additives may be present in the silicone gripping dots composition, for example, filler (including reinforcing or decorative filler), ultraviolet (UV) stabilizers, pigments, and the like, or a combination comprising at least one of these. Where additives are present, the amounts used are selected so that the desired properties of the silicone gripping dot composition are not adversely affected by the presence of the additives.

Although a few embodiments have been described in detail above, other modifications are possible. Other embodiments may be within the scope of the following claims.

The invention claimed is:

1. A leash for a surfboard, the leash comprising:
a cuff for attaching to a surfer's body;
an attachment mechanism for attaching to the surfboard; and
a leash cord connected between the cuff and the attachment mechanism, the leash cord comprising an extruded thermoplastic urethane cord containing an elastic fiber rope that has an elongation elasticity that corresponds with an elongation elasticity of the thermoplastic urethane cord.

2. The leash in accordance with claim 1, wherein the elastic fiber rope is connected directly to the attachment mechanism.

3. The leash in accordance with claim 1, wherein the elastic fiber rope is selected from the group of elastic fiber ropes that consists of: sisal, manila, jute, hemp, natural polyamide fibers, rayon, cotton, cellulosic fibers, nylon, polyester, polyethylene terephthalate, polypropylene, Ultra-High molecular weight polyethylene (UHMWPE), and aramid.

4. The leash in accordance with claim 1, wherein the elastic fiber rope is connected directly to both the attachment mechanism and the cuff.

5. A leash for a surfboard, the leash comprising:
a cuff for attaching to a surfer's body;
an attachment mechanism for attaching to the surfboard; and
a leash cord connected between the cuff and the attachment mechanism, the leash cord comprising a hollow thermoplastic urethane cord containing an elastic fiber rope that has an elongation elasticity that corresponds with an elongation elasticity of the hollow thermoplastic urethane cord.

6. The leash in accordance with claim 5, wherein the elastic fiber rope is connected directly to the attachment mechanism.

7. The leash in accordance with claim 5, wherein the elastic fiber rope is selected from the group of elastic fiber ropes that consists of: sisal, manila, jute, hemp, natural polyamide fibers, rayon, cotton, cellulosic fibers, nylon, polyester, polyethylene terephthalate, polypropylene, Ultra-High molecular weight polyethylene (UHMWPE), and aramid.

8. The leash in accordance with claim 5, wherein the elastic fiber rope is connected directly to both the attachment mechanism and the cuff.

9. A leash for a surfboard, the leash comprising:
a cuff for attaching to a surfer's body;
a first attachment mechanism connected with the cuff;
a second attachment mechanism for attaching to the surfboard; and
a leash cord connected between the first attachment mechanism and the second attachment mechanism, the leash cord comprising a hollow thermoplastic urethane cord containing an elastic fiber rope that has an elongation elasticity that corresponds with an elongation elasticity of the hollow thermoplastic urethane cord.

10. The leash in accordance with claim 9, wherein the elastic fiber rope is selected from the group of elastic fiber ropes that consists of: sisal, manila, jute, hemp, natural polyamide fibers, rayon, cotton, cellulosic fibers, nylon, polyester, polyethylene terephthalate, polypropylene, Ultra-High molecular weight polyethylene (UHMWPE), and aramid.

* * * * *